US008534121B2

(12) United States Patent
Golden et al.

(10) Patent No.: US 8,534,121 B2
(45) Date of Patent: Sep. 17, 2013

(54) GOLF CLUB COMPRISING A PIEZOELECTRIC SENSOR

(75) Inventors: Charles Edward Golden, East Carlsbad, CA (US); Peter J. Gilbert, East Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 267 days.

(21) Appl. No.: 13/033,839

(22) Filed: Feb. 24, 2011

(65) Prior Publication Data

US 2011/0151987 A1 Jun. 23, 2011

Related U.S. Application Data

(63) Continuation-in-part of application No. 11/979,787, filed on Nov. 8, 2007.

(51) Int. Cl.
*A63B 53/00* (2006.01)

(52) U.S. Cl.
USPC ..... 73/65.03; 73/12.02

(58) Field of Classification Search
USPC ..... 73/65.03
See application file for complete search history.

(56) References Cited

U.S. PATENT DOCUMENTS

| | | | | |
|---|---|---|---|---|
| 3,270,564 A | | 9/1966 | Evans | 73/432 |
| 3,792,863 A | | 2/1974 | Evans | 273/186 A |
| 3,945,646 A | * | 3/1976 | Hammond | 473/223 |
| 4,088,324 A | | 5/1978 | Farmer | 273/186 A |
| 4,928,965 A | | 5/1990 | Yamaguchi et al. | 273/78 |
| 5,694,340 A | * | 12/1997 | Kim | 702/141 |
| 6,196,932 B1 | | 3/2001 | Marsh et al. | 473/223 |
| 7,143,639 B2 | | 12/2006 | Gobush | 73/65.03 |
| 7,235,020 B1 | * | 6/2007 | Christensen | 473/226 |
| 7,395,696 B2 | | 7/2008 | Bissonnette et al. | 73/65.03 |
| 8,142,304 B2 | * | 3/2012 | Reeves | 473/223 |
| 2002/0173364 A1 | | 11/2002 | Boscha | |
| 2005/0037862 A1 | * | 2/2005 | Hagood et al. | 473/345 |
| 2007/0001106 A1 | * | 1/2007 | Schmidt et al. | 250/225 |
| 2010/0292024 A1 | * | 11/2010 | Hagood et al. | 473/329 |
| 2012/0277018 A1 | * | 11/2012 | Boyd et al. | 473/224 |

FOREIGN PATENT DOCUMENTS

JP 07155416 A 6/1995

OTHER PUBLICATIONS

Notice of Allowance dated Oct. 26, 2011 of corresponding U.S. Appl. No. 12/401,079.

Notice of Allowance dated Dec. 19, 2011 of corresponding U.S. Appl. No. 12/401,102.

Notice of Allowance dated Jan. 11, 2012 of corresponding U.S. Appl. No. 11/979,787.

(Continued)

*Primary Examiner* — Lisa Caputo
*Assistant Examiner* — Jamel Williams
(74) *Attorney, Agent, or Firm* — Smith, Gambrell & Russell, LLP

(57) ABSTRACT

An apparatus for determining the kinematic characteristics of a golf club are disclosed. The apparatus includes at least one piezoelectric component selectively positioned within or upon at least one portion of a golf club. When the club head impacts an object such as a golf ball, the piezoelectric component is operable to determine the velocity of the club. It may also be desirable for the piezoelectric component to determine the magnitude of vibration during impact and swing speed. In this manner, the piezoelectric component may function determine the efficiency of a golf club swing.

20 Claims, 5 Drawing Sheets

(56) References Cited

OTHER PUBLICATIONS

U.S. Appl. No. 11/524,304, filed Mar. 22, 2007 entitled "Golf Assessment and Improvement System".
U.S. Appl. No. 11/364,343, filed Sep. 6, 2007 entitled "IR System for Kinematic Analysis".
U.S. Appl. No. 10/915,804, filed Aug. 9, 2004 entitled "Method and Apparatus for Active Control of Golf Club Impact".
U.S. Appl. No. 10/898,367, filed Dec. 8, 2005 entitled "Launch Monitor".
U.S. Appl. No. 10/861,443, filed Dec. 8, 2005 entitled "Launch Monitor".
Vernon D. Barger, "Rigid-body dynamics", in AccessScience@McGraw-Hill, Accessed online at <http://www.accessscience.com, DOI 10.1036/1097-8542.590400>. Accessed online on Nov. 19, 2009.
Hocknell, A., Jones, R., Rothberg, S., "Experimental analysis of impacts with large elastic deformation: I. Linear motion." Meas. Sci. Technol. 7 (1996) 1247-1254.
Fitzpatrick, K. and Anderson, R., "Validation of accelerometers and gyroscropes to provide real-time kinematic data for golf analysis." The Engineering of Sport 6. (2006) 4 pp. 155-160.
Non-Final Office Action dated Sep. 18, 2008 of corresponding U.S. Appl. No. 11/979,787.
Final Office Action dated Nov. 27, 2009 of corresponding U.S. Appl. No. 11/979,787.
Non-Final Office Action dated Apr. 9, 2010 of corresponding U.S. Appl. No. 11/979,787.
Non-Final Office Action dated Mar. 16, 2011 of corresponding U.S. Appl. No. 11/979,787.
Non-Final Office Action dated Jun. 22, 2010 of corresponding U.S. Appl. No. 12/401,079.
Non-Final Office Action dated Mar. 18, 2011 of corresponding U.S. Appl. No. 12/401,079.
Non-Final Office Action dated Jun. 22, 2010 of corresponding U.S. Appl. No. 12/401,102.
Non-Final Office Action dated Mar. 21, 2011 of corresponding U.S. Appl. No. 12/401,102.
Final Office Action dated Jul. 7, 2011 of corresponding U.S. Appl. No. 11/979,787.
Final Office Action dated Jul. 15, 2011 of corresponding U.S. Appl. No. 12/401,102.

* cited by examiner

GOLF CLUB COMPRISING A PIEZOELECTRIC SENSOR

CROSS-REFERENCE TO RELATED APPLICATIONS

This application is a continuation-in-part of U.S. application Ser. No. 11/979,787 filed on Nov. 8, 2007, the entirety of which is incorporated by reference.

FIELD OF THE INVENTION

The present invention relates to measuring the kinematic characteristics of a golf club before, during, and after impacts with a golf ball. More specifically, the present invention relates to measuring the swing speed, rotation, impact efficiency, and acceleration of a golf club by using one or more piezoelectric device positioned within or upon a golf club.

BACKGROUND OF THE INVENTION

The growing interest in the game of golf has spurred golf equipment manufacturers to increase the variety of equipment that they produce. Revolutions in computing and advances in material science have simultaneously allowed equipment manufacturers to meet the demands of consumers in ever more precise ways. Golf balls, for instance, are now manufactured specifically to give a golfer the right "feel" when the club face strikes the golf ball. Golf balls are also manufactured to fly farther by manipulating the patterns formed by the dimples on the surface of the golf ball. With respect to golf clubs, newer materials have allowed golf club designers to produce lighter and stronger golf clubs. Features of the golf clubs have also been varied to manipulate head characteristics, such as center of mass, face angle, and face texture.

Golfers collectively spend millions of dollars each year attempting to fine tune each aspect of their game. For both amateur and professional golfers alike, equipment can often be a key to success. To satisfy the demand for equipment while accommodating the different body types, swing mechanics, and varying levels of skill, golf equipment manufacturers have produced equipment that is limited only be the imagination and the requirements of the United States Golf Association (USGA).

Depending on the skill of the golfer, their playing style, and their personal preferences, specific equipment may be selected to assist the golfer in obtaining the optimal performance. In the past, a golf professional would assist a golfer in choosing their equipment either based on their body type, general information provided by the golfer about their style of play, and/or observing the golfer's swing with the naked eye. More recently, golf professionals have used devices referred to as "launch monitors" to observe a player's swing characteristics. By observing a golfer's swing with different clubs and balls, a launch monitor provides a golf professional with more information on which to base a club and/or ball recommendation.

A limitation of present methods and apparatus for measuring the kinematics of a golf club is that the measurements are taken by outside equipment. For instance, a launch monitor often acquires images of a golf club in motion and then determines the kinematic characteristics of the club based on those images. While the precision and accuracy of these devices is constantly improving, it is also desirable to obtain the kinematic characteristics of the golf club from the golf club itself That is, a continuing need exists for a method and apparatus that allows a golf club to directly measure and relay the kinematic information of the golf club. Moreover, a continuing need exists for a golf club that has the ability to measure and relay its kinematic characteristics without being perceptible to a golfer.

SUMMARY OF THE INVENTION

According to one aspect of the invention, a golf club is equipped with a plurality of sensors for determining the kinematics of the golf club. The club comprises a hollow shaft comprising an exterior and an inner surface. In addition, a grip with an interior and exterior surface may be coupled to the shaft. The club may also have a head, which is comprised of a face, a heel, a toe, a top line, a sole, a hosel, a rear, and a center of gravity. According to one aspect of the invention, the sensors comprise piezoelectric components that may be removable.

In one embodiment, a plurality of piezoelectric components is placed along the length of the shaft. For example, the piezoelectric components may be coupled to the inner surface of the shaft. The shaft may be divided into three or more portions comprising a first portion located proximate the club head, a second intermediate portion, and a third portion located proximate the grip. According to one aspect of the invention, a first piezoelectric component may be located in the first portion, a second piezoelectric component may be located in the second portion, and a third piezoelectric component may be located in the third portion. In addition, the first, second, and third portions may be equal in length. In one embodiment, a piezoelectric component may be located near the midpoint of the shaft. In another embodiment, a piezoelectric component may be positioned on the exterior or interior of the grip.

In addition, one or more piezoelectric components may be located within the club head. In one embodiment, a first piezoelectric component may be located between a toe and a midpoint of the face of the club head. In addition, a second piezoelectric component may be located between a heel and a midpoint of the face of the club head. A third piezoelectric component may be located rearward the center of gravity of the club head, and may be aligned with the midpoint of the face.

According to one aspect, the piezoelectric component comprises an accelerometer. In one embodiment, a first, second, and/or third piezoelectric component may comprise an accelerometer.

A display may be connected to at least one of the piezoelectric components. In addition, a processor and a memory may be operatively connected to at least one of the piezoelectric components. According to one aspect of the invention, the golf club may include a wireless transmitter. In one embodiment, the piezoelectric component is operable to determine at least one measurement selected from the following: swing speed, golf club acceleration, golf club deceleration, lag, the magnitude of golf club vibration, and combinations thereof.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

The determination of swing speed, impact efficiency, and acceleration can assist a golfer in correcting his/her swing and generally improving his/her golf game. One embodiment of the present invention allows these and other kinematic characteristics to be determined by including at least one piezoelectric component in or on various portions of a golf club. The golf club includes a grip 100, a shaft 105, and a club head 110. The club head 110 comprises a face, a heel, a toe, a top line, a sole, a hosel, and a rear.

Preferably, the at least one piezoelectric component is selectively positioned towards the rear of the inner volume of the club head. More preferably, it is also desirable for the piezoelectric component to be positioned far enough towards the rear of the club head that it is behind the club head's center of gravity. In a preferred configuration, the piezoelectric component is also positioned approximately near the middle of the face of the club head.

According to one aspect, the present invention may be used with any type of golf club. Skilled artisans will recognize that the present invention is not intended to be limited to any particular type of golf club, golf club head, or golf club components. Any type of golf club, including woods, irons, drivers, putters, wedges, and the like may be used. The golf club may also comprise any type of shaft or handle known to those skilled in the art. Any material or combination of materials may also be used, including but not limited to, metal, wood, alloys, composites, plastic, and rubber. If the club head defines an internal volume, the measuring device(s) may be positioned within the defined volume. Alternatively, the measuring device(s) may be positioned on an external portion of the club head, club shaft, or grip. Similarly, if the club shaft of the club defines an internal volume, the measuring device(s) may be positioned within the defined volume.

Figure 1:
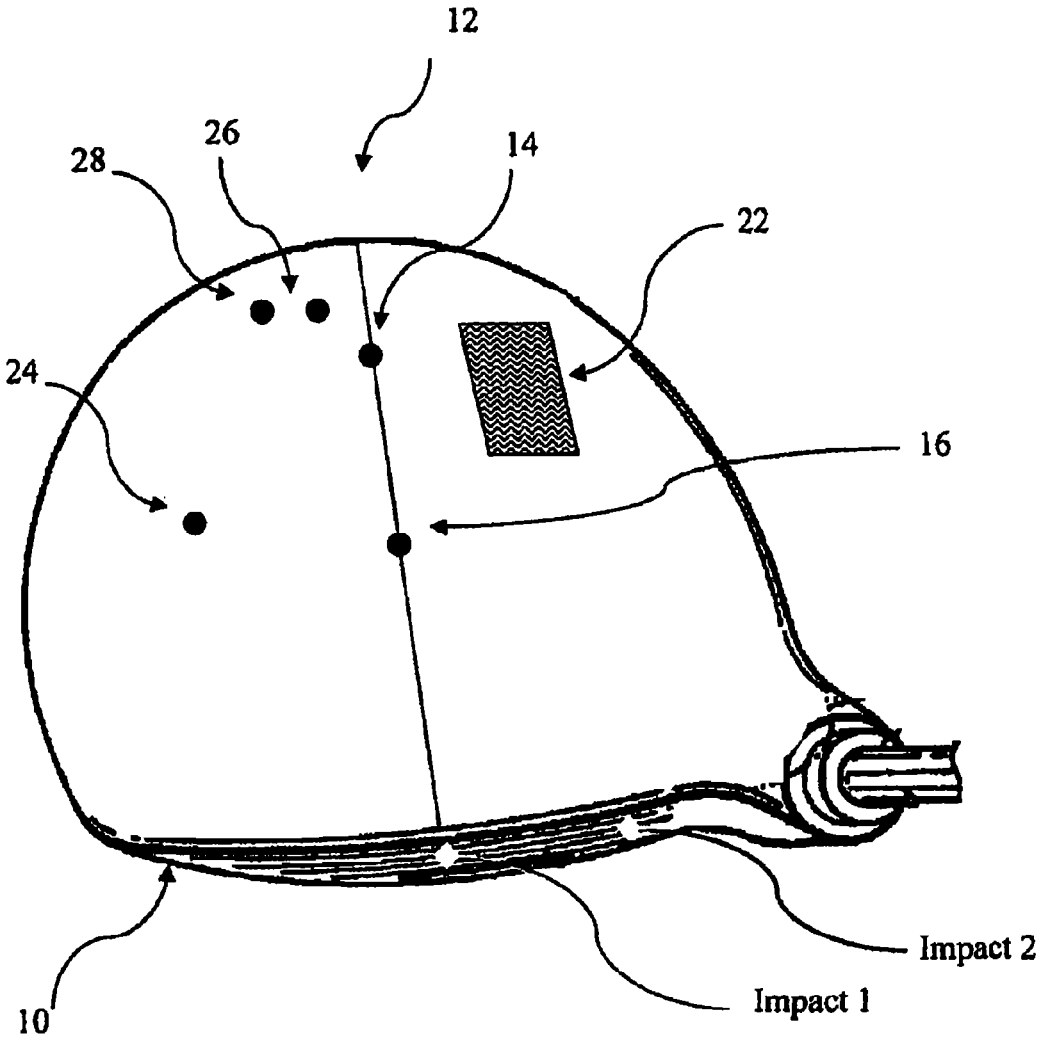
FIG. 1 shows a first exemplary embodiment of the golf club head of the present invention.
Figure 3:
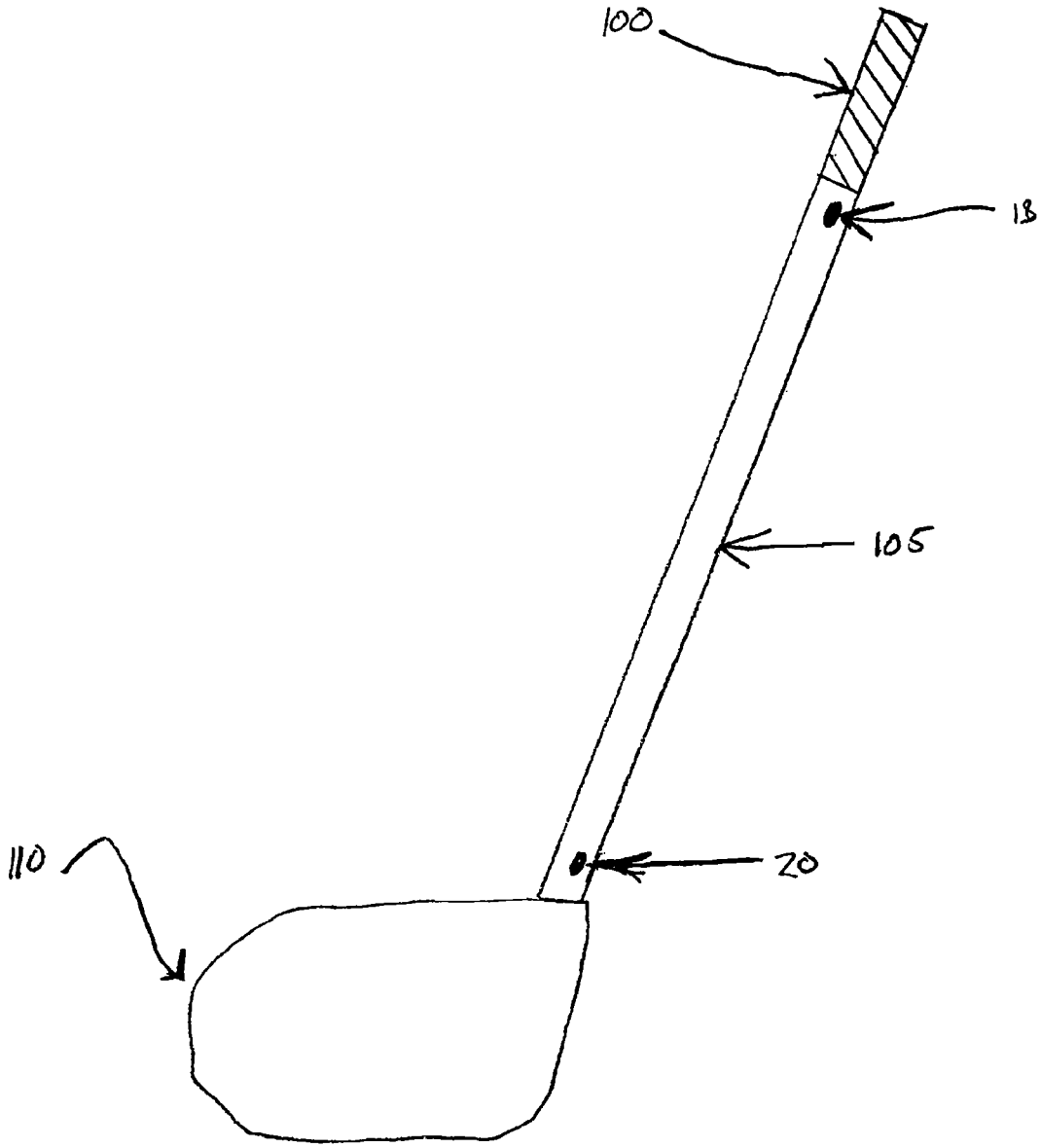
FIG. 3 shows an exemplary embodiment of the golf club of the present invention.

In one embodiment, the piezoelectric device preferably comprises at least one accelerometer 14 that measures the impact of an object, as shown in FIG. 1. The accelerometer is operable to measure both the static acceleration of the club using the Earth's gravity, and the shock or vibration from an impact. Though any piezoelectric device or accelerometer known to those skilled in the art maybe used, one example of an accelerometer that may be used is manufactured by Freescale Semiconductor, Inc. The accelerometer may be powered by any desirable power source. According to one embodiment of the present invention, the piezoelectric device includes multiple accelerometers 14 located on various portions of a golf club, as shown in FIG. 3. In one embodiment, multiple accelerometers are linked to a single power source 50. In another embodiment, the power source 50 is located in an internal volume defined by the club shaft. In another embodiment, the power source 50 is located in an internal volume defined by the club head.

Of course, it is desirable for the power source 50 to have a minimum weight and size necessary to power the accelerometer for a desired amount of time, as it is required to fit within the inner volume of the club head without perceptibly impacting the weight of the club. Preferably, the power source 50 provides power to the microcontroller for at least about 2 hours or more. More preferably, the power source 50 provides power to the accelerometer for at least 4 hours or more, and most preferably the power source 50 provides power to the accelerometer for at least 6 hours or more.

As conservation of power is typically a consideration in any mobile application, it is desirable for the present invention to conserve power when possible. In particular, it may be desirable for the power supply to automatically shut down when the club is not in use. For instance, if the club has not moved for a predetermined period of time, a processor (described below) may determine that the club is not in use. When this determination is made, the processor may shut down the power source until it is determined that the club is being used again. Alternately, the power source may go into a "sleep-mode" that allows it to stay on while conserving power. Alternately, the golf club may include a power switch that allows a golfer to manually turn the power source on and off The power switch may be located on any portion of the golf club. In one embodiment, the power switch is located on the grip of the club. In another embodiment, the power switch is located on the shaft of the club. According to one aspect of the invention, the power switch is located on the golf club head.

In one embodiment, the power source is preferably rechargeable and can be recharged in a variety of manners known to those skilled in the art. For instance, the power source may be positioned such that is may be removed from the golf club and inserted into a charging device. Alternately, the golf club may have a port that is operatively connectable to a power supply that can recharge the battery. In other embodiments, the power source may be wirelessly rechargeable, through induction or the like. In some embodiments the power source may not be rechargeable. In such an embodiment, positioning the power source such that it can be removed from the golf club allows it to be easily interchangeable.

In order to allow information to be recorded, a memory 26 is operatively connected to the at least one accelerometer 14. When there are multiple accelerators present on the golf club, it may be preferable that each accelerator is operatively connected to a single memory device. Alternatively, it may be preferably that multiple accelerators are operatively connected to multiple independent memory devices located on the golf club head, the golf club shaft, and/or the golf club grip. The accelerators may be operatively connected to the memory in groups according to desired uses or by location on the golf club. For example, multiple accelerators on the exterior or contained in the inner volume of a golf club head may be operatively connected to a single memory location on the exterior or contained in the inner volume of the golf club head. Similarly, multiple accelerators on the exterior or contained in the inner volume of the golf club shaft may be operatively connected to a single memory.

Any type of memory 26 may be used as desired including, but not limited to, random access memory (RAM), read-only memory (ROM), flash memory, erasable programmable read-only memory (EPROM), electrically erasable programmable read-only memory (EEPROM), or combinations thereof. The memory 26 is operable to store the kinematic information for a desired period of time. Also included is a processing device 28, such as a microcontroller. The processing device 28 may be operatively connected to at least one of the memory 26, power source, or accelerometer 14.

It is also desirable for the information acquired by the present invention to be displayed so that a golfer can analyze the kinematic characteristics of their performance. One way to display the information measured and recorded by the accelerometer is to operatively connect a display 22 (FIG. 1), such as an LCD, LED, or other type of display to the accelerometer. In this embodiment, the display is selectively positioned away from the striking surface of the club, e.g., the face of the club or the shaft of the club. The display may be configured and dimensioned such that it does not obstruct or otherwise affect the movement of the club. It may be desirable to employ a flexible, flat display, such as those developed and manufactured by companies such as Lucent, DuPont, 3M, and Phillips. Using a flexible display allows the display to follow the natural contour of the club head or club shaft while still allowing a golfer to view the desired information.

In one embodiment, the display may be configured and dimensioned such that it forms a portion of the golf club head's outer surface, such as the skirt or perimeter of the golf club. Alternately, the display may be positioned on top of a portion of the golf club head. If such a configuration is selected, it is desirable for the display to be adapted such that it does not appreciably affect the aerodynamic qualities of the golf club head. One way that this may be achieved is to secure the display to the golf club head, and then provide a transparent coating or layer over the display to hold it in place. Other methods and/or apparatus known to skilled artisans may also be used to minimize the display's effect on the aerodynamic qualities of the club head.

Another way to display the information measured and recorded is to include a wireless transmitter 24 that is operatively connected to the accelerometer. The wireless transmitter 24 may be positioned on any portion of the golf club. For example, the wireless transmitter 24 may be positioned within the inner cavity of the club head, within the inner cavity of the club shaft, within the inner cavity of the grip, or otherwise. The weight of the wireless transmitter 24 is preferably minimized such that it has a negligible effect on the overall weight, or weight distribution, of the golf club. In another embodiment, the information obtained and stored by the present invention may be uploaded to another processor, e.g., a computer, though a manual connection, e.g., a universal service bus (USB) connection. The connection may be selectively positioned on any part of the golf club head, or shaft, however it is preferably placed away from the striking surface of the club, e.g., the face.

It is preferable for the present invention to be positioned, configured, and dimensioned such that it measures the kinematic characteristics of the golf club without being perceived by a golfer. Along these lines, the piezoelectric component, such as an accelerometer, is preferably fastened or coupled to at least a portion of the interior surface of either the club head or shaft. The accelerometer may be fastened to the interior surface of either the club head or shaft using any method or apparatus known to those skilled in the art, such as glue, epoxy, resin, or mechanical fasteners. For instance, according to one aspect of the invention the accelerometer is fastened to the inner volume of the club head or shaft using an insert placed inside the club head or shaft. The insert may be comprised of any material, such as urethane or the like. Preferably, the weight of the material used to fasten the accelerometer to the inner volume of the club head or shaft is minimized so that its effect on the overall weight and weight distribution of the club head is reduced.

According to another aspect of the invention, one or more piezoelectric components, such as an accelerometer, are coupled to the exterior of the golf club. In one embodiment, the piezoelectric components are removable from the club head and shaft. The removable nature of the piezoelectric components offers the ability to compare golf clubs without the difficulty of removing the piezoelectric components from the interior of a club head and shaft and reinstalling the piezoelectric components to the interior of another club head and shaft. Furthermore, different components of the golf club, such as the head, shaft, and grip, may be easily interchanged and tested to determine the optimal combination of components.

Any number of accelerometers may be used as desired. As shown in FIG. 1, one accelerometer may be selectively positioned within the inner volume of the club head. The accelerometer is preferably positioned near the midpoint of the face 10 and towards the rear 12 of the club head. It is also desirable for the accelerometer 14 to be positioned to the rear 12 of the center of gravity 16, e.g., between the center of gravity 16 and the rear 12 of the club head. When positioned in this manner, the accelerometer 14 is operable to measure the forces generated by an impact of the club head with a golf ball. If the club head strikes the golf ball in the center of the face (impact 1), the accelerometer 14 will measure only a single force component that is perpendicular to the face 10 because the accelerometer 14 is also positioned at the center of the face. However, when the club head strikes the golf ball off center (impact 2), the accelerometer's 14 position at the center of the club face allows it to measure the various components of the force, e.g., a "side" force that is generated by the impact.

Figure 2:
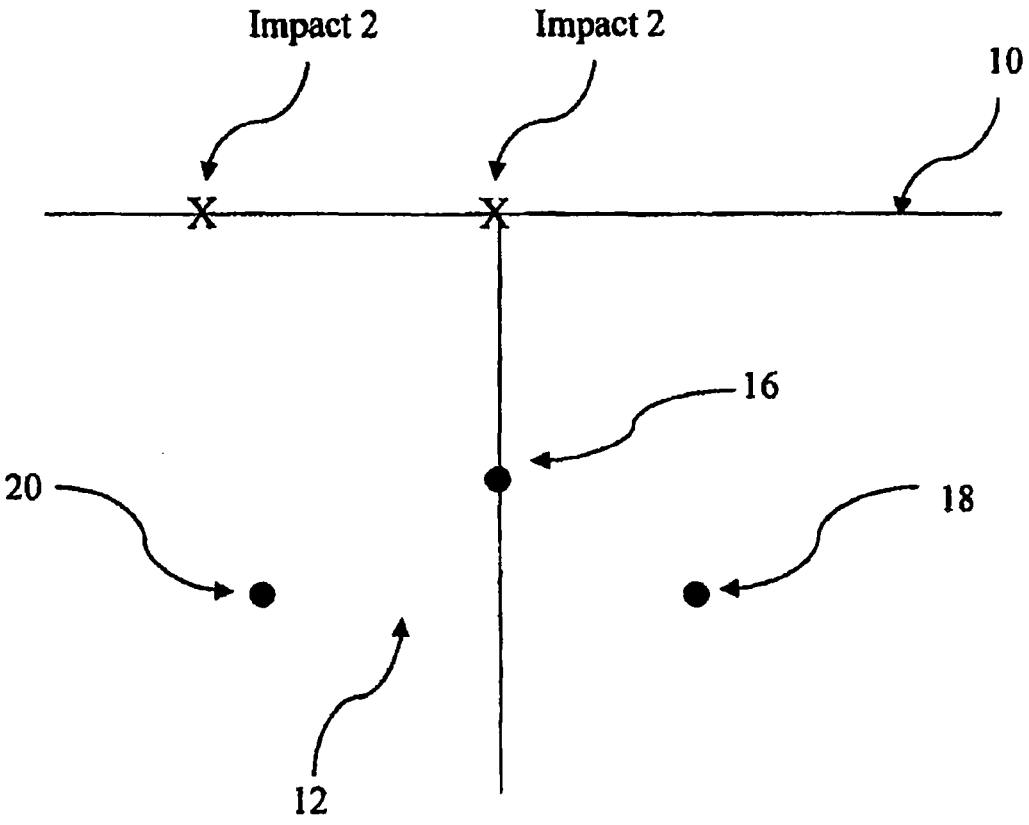
FIG. 2 shows a second exemplary embodiment of the golf club head of the present invention.

In an alternate embodiment, the present invention may include two or more accelerometers 18, 20. As shown in the FIG. 2 embodiment, two accelerometers 18, 20 may also be positioned within the inner cavity of the club head. A first accelerometer 18 may be positioned between the midpoint of the face and the toe of the club, and the second accelerometer 20 may be positioned between the midpoint of the face and the heel of the club, as shown in FIG. 2. With respect to the center of gravity 16 and the rear 12 of the club, each accelerometer 18, 20 is positioned in a similar manner as described above with respect to the embodiment comprising a single accelerometer.

Figure 4:
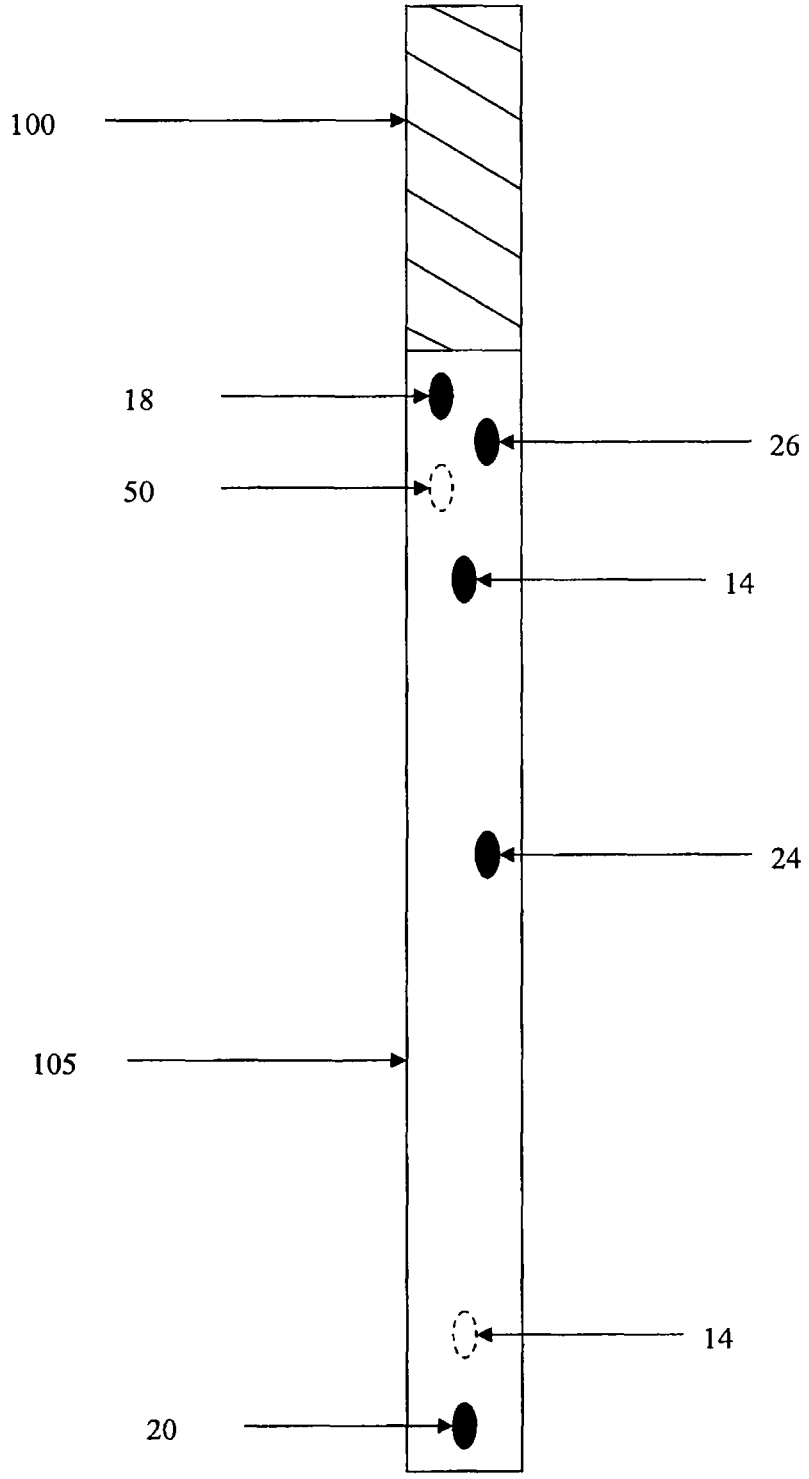
FIG. 4 shows an exemplary embodiment of the golf club shaft of the present invention.
Figure 5:
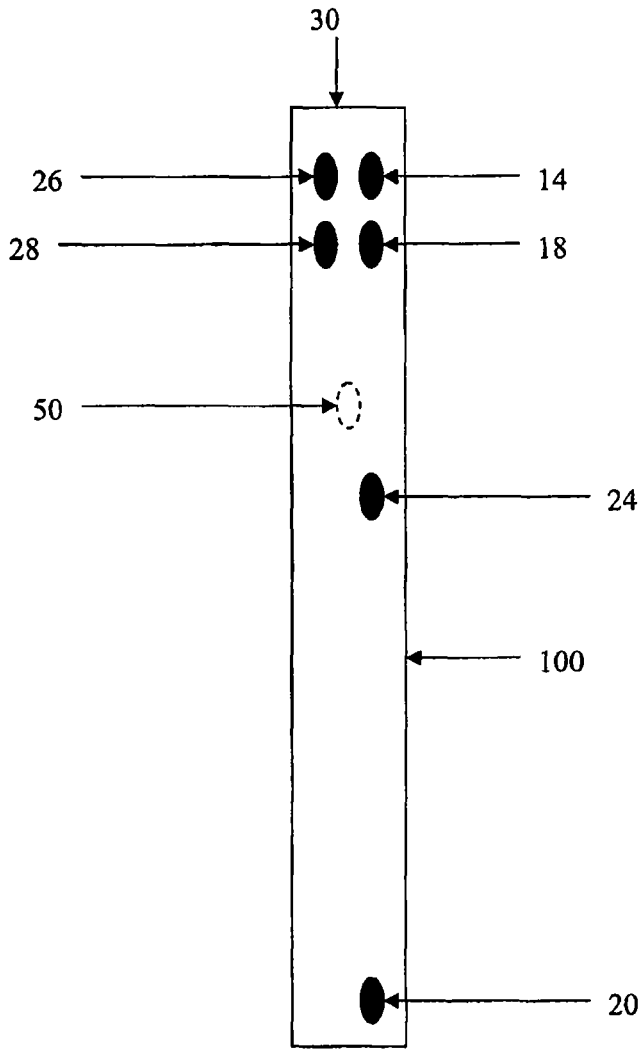
FIG. 5 shows a first exemplary embodiment of the golf club grip of the present invention.

In a another embodiment of the present invention, two or more accelerometers 18, 20 may be positioned on an interior surface of the club shaft. As shown in FIG. 4, a first accelerometer 18 may be placed near the top of the club shaft, and the second accelerometer may be placed near the bottom of the club shaft 20. In addition an accelerometer 20 may be placed near the point that the club shaft is inserted or attached to the club head (FIG. 3). Furthermore, two or more accelerometers 18, 20 may be placed on the interior or exterior of the club grip. For example, a first accelerometer 18 may be placed near the top portion of the club grip, and a second accelerometer 20 may be placed near the bottom of the club grip (FIG. 5). Alternatively, an accelerometer 30 may be placed in or on the top of the club grip.

According to one aspect of the invention, the shaft may be divided into three or more portions. For example, a first portion may include the portion of the shaft that is coupled to the club head or hosel of the club head. A third portion of the shaft may include the portion that is coupled with the grip of the golf club. A second portion of the shaft may include the area of the shaft that is between the first and third potions. In one embodiment, the first, second, and third portions of the shaft are equal in length. One or more piezoelectric components may be placed on or in the shaft on each of the three portions. The placement of the sensors along the three portions of the shaft allows for the identification of lagging in the shaft. For example, a golfer with a high swing speed using a highly flexible (high flex strength) golf club shaft may experience excessive lagging of the lower portion of the club proximate the club head with respect to the upper portion proximate the grip. Thus, measuring the kinematics of the golf club shaft at various locations along the golf club shaft enables an effective and detailed analysis of the amount of lag, which allows for the golfer to properly determine the proper flex strength of the golf club shaft for a particular golf club head.

In another embodiment, the present invention includes more than two accelerometers. The accelerometers may be located on any portion of the golf club including, but not limited to, an inner surface of the club head, an exterior surface of the club head, an inner surface of the club shaft, an exterior surface of the club shaft, the exterior surface of the club grip, the interior surface of the club grip, the top of the club grip, and combinations thereof.

One advantage of using two or more accelerometers in or on the club head is that the forces generated at different parts of the club may be measured. For example, if the club head strikes the ball off center (impact 2), as shown in FIG. 2, accelerometer 20 will measure only one force component that is substantially perpendicular to the face 10 of the club because this accelerometer is in line with the impact location on the face. Relative to the position of accelerometer 18, however, the impact will be off center, causing the accelerometer 18 to record two or more force components based on the side force that is generated. Thus, one advantage of using two accelerometers 18, 20 is that the area of impact may be more accurately determined relative to the center of the face 10. Moreover, the force components at different parts of the club head may also be determined with a greater degree of accuracy.

Though it is preferable for the accelerometer to be positioned as described above, the other elements that are operatively connected to the accelerometer may be selectively positioned as desired. That is, elements such as the processor, display, and power supply may be positioned in different areas of the golf club. When positioning the other elements, the overall weight distribution of the club may be taken into account. In other words, the weight of the other elements can be distributed such that the entire body of the golf club has a desired weight distribution, e.g., more weight lower, rear of the club, beneficially positioning the club head center of gravity. Each of these elements may be secured to the inner volume of the club head or club shaft in a similar manner as those described above with respect to the accelerometer.

The apparatus of the present invention enables a plurality of kinematic characteristics of the golf club to be determined. For example, the apparatus described above allows characteristics such as acceleration, deceleration, velocity at impact, and acceleration/deceleration through impact to be measured. Other measurements that may be calculated by the present invention include, but are not limited to, club head velocity, club head momentum, club head path angle, club head attack angle, club head loft, club head droop, club head face angle, club head face spin, club head droop spin, club head loft spin, ball impact location on the club head face, and swing time.

The present invention is also operable to be used as an efficiency meter. In other words, an accelerometer may be positioned at the center of the club head. When the golf club strikes a golf ball off center, e.g., towards the toe or heel, the accelerometer will record a different signal than if the golf ball was struck at the center of the face. By measuring the amplitude and frequency content of vibration, the efficiency of the golf club swing may be determined.

A similar principle applies to embodiments that use two or more accelerometers. In the FIG. 2 embodiment, when the club head strikes a golf ball off center, closer to the heel, accelerometer 20 will measure a larger vibration than accelerometer 18. Similarly, when the club head strikes the golf ball off center, closer to the toe, accelerometer 18 will measure a larger vibration than accelerometer 20. Through testing, theoretical maximum and minimum vibrations can be pre-programmed into the memory. This data may be customized to the particular golfer by factoring in the golfer's typical or measured swing speed, as greater swing speeds create greater force, acceleration, and vibration values. By comparing the measured value of a particular swing to the data stored in the memory, the golfer's performance can be quantified and displayed on the screen, giving the golfer instant feedback regarding the swing.

According to another aspect, the method of the present invention includes swinging the golf club of the present invention. Initially, the club is positioned near the golf ball as a golfer lines up his/her shot, referred to as the initial position. The club goes through three stages with respect to the initial position, commonly referred to as the backswing, the downswing, and the follow-through. During the backswing and downswing, the accelerometer measures the acceleration of the golf club head and/or golf club shaft, as well as the lag time between the various portions of the golf club. Subsequent to impact, i.e., during the follow-through, the accelerometer measures the deceleration of the golf club head and/or shaft. During impact between the golf club head and the golf ball, the velocity of the golf club may be determined. The velocity during impact is determined based on the measured force components, described in detail above. Optionally, the efficiency of the impact may also be determined as described above.

After a golf swing has been completed, the information may be displayed. Preferably, the information is displayed on a screen 22 (FIG. 1) that is configured and dimensioned to be part of the golf club, as described above. In other embodiments, the stored information may be transmitted to another processor that may display the information. The transfer of information may be wired or wireless. The information, e.g., the acceleration, deceleration, and velocity, is preferably displayed numerically. In a more preferred embodiment, however, a graphical illustration of the acceleration in each stage of the swing may be provided. In embodiments where kinematic information is transferred to an external processor, the information may be analyzed and charts, graphs, or other types of analysis may be performed.

For instance, the swing speed of the golf club may be measured and displayed. In addition, the acceleration and velocity of the golf club head may be used to calculate the distance and trajectory of the golf ball. Alternately, the present invention may also be combined with other types of electronic monitoring equipment. For instance, the present invention may be used in combination with external launch monitors that measure the kinematic characteristics of both the golf club and the golf ball. The information obtained by the launch monitor may be combined with the kinematic information measured by the present invention in order to measure and display swing speed, ball trajectory and distance, and ball spin. Examples of launch monitors that may be used in combination with the present invention include U.S. Pat. Nos. 7,395,696 and 7,143,639, the entireties of which are incorporated herein by reference. The present invention may also be used in combination with other methods and apparatus for measuring the kinematics of both golf equipment and a golfer's body. Examples of such methods and apparatus are disclosed in U.S. patent application Ser. Nos. 11/364,343 and 11/524,304, the entireties of which are also incorporated herein by reference.

Although the present invention has been described with reference to particular embodiments, it will be understood to those skilled in the art that the invention is capable of a variety of alternative embodiments within the spirit of the appended claims. For example, while the inventive aspects have been described above mainly in conjunction with a hollow golf club, the invention may also take the form of a solid golf club such as an iron-type golf club. Moreover, not all disclosed aspects need to be included in any single embodiment. Further, directional references disclosed herein are with respect to the club head at the address position and are only illustrative in nature.

What is claimed is:

1. A golf club comprising:

a hollow golf club shaft comprising an exterior and an inner surface;

a golf club grip comprising an exterior and an interior surface coupled to the shaft;

a club head coupled to the shaft, wherein the club head comprises a face, a heel, a toe, a top line, a sole, a hosel, a rear, and a center of gravity;

a first plurality of piezoelectric components selectively positioned along the length of the golf club shaft; and a second plurality of piezoelectric components positioned within the club head, wherein a first piezoelectric component is located between a toe and a midpoint of the face of the golf club head, a second piezoelectric component is located between a heel and a midpoint of the face of the golf club head, and a third piezoelectric component is located rearward of the center of gravity of the golf club head.

2. The golf club of claim 1, wherein at least one of the first plurality of piezoelectric components is coupled to the inner surface of the shaft.

3. The golf club of claim 1, wherein at least one of the first plurality of piezoelectric an accelerometer.

4. The golf club of claim 3, wherein the first plurality of piezoelectric components comprises at least two piezoelectric components each comprising an accelerometer.

5. The golf club of claim 4, wherein the first plurality of piezoelectric components comprises at least three piezoelectric components each comprising an accelerometer.

6. The golf club of claim 5, wherein the shaft is divided into at least three portions comprising a first portion located proximate the club head, a second intermediate portion, and a third portion located including the grip.

7. The golf club of claim 6, wherein the first, second, and third portions are equal in length.

8. The golf club of claim 6, wherein one of the at least three piezoelectric components in the first plurality of piezoelectric components is located in the first portion, another of the at least three piezoelectric components in the first plurality of piezoelectric components is located in the second intermediate portion, and another of the at least three piezoelectric components in the first plurality of piezoelectric components is located in the third portion.

9. The golf club of claim 1, wherein the second plurality of piezoelectric components are removable.

10. The golf club of claim 1, further comprising a display connected to at least one of the first plurality of piezoelectric components.

11. The golf club of claim 1, further comprising a processor and a memory operatively connected to at least one of the first plurality of piezoelectric components.

12. The golf club of claim 1, wherein the first and second pluralities of piezoelectric components are operable to determine at least one measurement selected from the list comprising swing speed, golf club acceleration, golf club deceleration, lag, the magnitude of golf club vibration, and combinations thereof.

13. A golf club comprising:

a golf club head comprising a face and a rear;

a golf club shaft comprising an exterior and an inner volume;

a golf club grip comprising an exterior and an interior;

a plurality of piezoelectric components coupled to at least one of the shaft and the club head;

a piezoelectric component selectively positioned rearward of a center of gravity of the golf club head and substantially aligned with a midpoint of the face of the golf club.

14. The golf club of claim 13, further comprising at least one piezoelectric component positioned near the midpoint of the golf club shaft.

15. The golf club of claim 13, wherein the at least one piezoelectric component is positioned on the exterior or interior of the golf club grip.

16. The golf club of claim 13, further comprising a wireless transmitter.

17. The golf club of claim 13, further comprising a memory and a processor operatively connected to at least one piezoelectric component.

18. The golf club of claim 13, wherein the piezoelectric components are operable to determine at least one measurement selected from the list comprising swing speed, golf club acceleration, golf club deceleration, lag, the magnitude of golf club vibration, and combinations thereof.

19. A golf club comprising:

a golf club head comprising a face and a rear;

a golf club shaft comprising an exterior and an inner volume;

a golf club grip comprising an exterior and an interior;

a first piezoelectric component coupled to the golf club shaft;

a second piezoelectric component selectively positioned rearward of a center of gravity of the golf club head.

20. The golf club of claim 19, wherein the first piezoelectric component is coupled to the inner volume of the golf club shaft.

* * * * *